United States Patent [19]

Fehrer

[11] Patent Number: 4,779,410

[45] Date of Patent: Oct. 25, 1988

[54] APPARATUS FOR MAKING A YARN

[76] Inventor: Ernst Fehrer, Auf der Gugl 28, A-4020 Linz, Austria

[21] Appl. No.: 138,959

[22] Filed: Dec. 29, 1987

[30] Foreign Application Priority Data

Jan. 16, 1987 [AT] Austria ..... 72/87

[51] Int. Cl.[4] ..... D01H 1/135; D01H 7/898

[52] U.S. Cl. ..... 57/401; 57/5; 57/408; 57/411

[58] Field of Search ..... 57/3, 5, 6, 401, 408–413

[56] References Cited

U.S. PATENT DOCUMENTS

| | | | |
|---|---|---|---|
| 4,524,580 | 6/1985 | Fehrer | 57/401 |
| 4,570,434 | 2/1986 | Stahlecker | 57/401 |
| 4,574,572 | 3/1986 | Fehrer | 57/5 |
| 4,601,167 | 7/1986 | Fuchs | 57/401 |
| 4,628,679 | 12/1986 | Stalder et al. | 57/401 |
| 4,640,090 | 2/1987 | Lembeck | 57/401 |

FOREIGN PATENT DOCUMENTS 377018 1/1985 Austria .

*Primary Examiner*—John Petrakes
*Attorney, Agent, or Firm*—Kurt Kelman

[57] ABSTRACT

An apparatus for making a yarn (6) comprises two juxtaposed, closely spaced apart twisting drums (1, 2), which rotate in the same sense and between themselves define a generally triangular twisting space (4), to which a vacuum is applied, fiber-feeding means and withdrawing means (7) for withdrawing the yarn (6) which has been formed in that the fibers fed to said twisting space have been twisted together in said twisting space. In order to effect a winding of covering fibers around a core of the yarn being formed, the fiber-feeding means comprise a feed roller, which procedes the twisting drums (1, 2) and is aligned with the triangular twisting space (6) in its longitudinal direction and has an axis of rotation that extends transversely to the center plane between the two twisting drums (1, 2), and the feed roller comprises a peripheral region (12) to which a vacuum is applied and a blasting region (14), which is axially disposed beside said peripheral region and faces the triangular twisting space (4) and in which a partial stream of fibers is formed.

5 Claims, 1 Drawing Sheet

II
III
1
2
3
4
5
6
7
8
9
10
11
12
13
14
15
16
16a
16b
17
18
19
20

APPARATUS FOR MAKING A YARN

BACKGROUND OF THE INVENTION

1. Field of the Invention

This invention relates to apparatus for making a yarn, comprising two juxtaposed, closely spaced apart twisting drums, which rotate in the same sense and between themselves define a generally triangular twisting space, to which a vacuum is applied, fiber-feeding means and withdrawing means for withdrawing the yard which has been formed in that the fibers feb to said twisting space have been twisted together in said twisting space.

2. Description of the Prior Art

When the fibers of a drawn roving have been twisted together between two twisting drums rotating in the same sense, an untwisting of the fibers in a false-twisting sense should be avoided and a proper cohesion of the fibrous structure should be ensured. This is accomplished in that covering fibers are wound about the drawn roving as it is twisted. During the winding of said covering fibers, the fact that the covering fibers have been parallelized by means of a drawing frame and that they are constrained to move on a feeding drum to which a vacuum is applied in a portion of the periphery of the drum should be utilized for the making of a uniform yarn having a high strength. From Austrian Patent Specification No. 377,018 it is known that this can be accomplished in that the drum used to feed the covering fibers, which drum is coaxial to one of the twisting drums, is driven at a surface speed which differs from that of the twisting drums so that the higher surface speed of the twisting drums which is required for the twisting of the drawn roving will not adversely affect the uniform winding of the covering fibers about the drawn roving. Whereas that control of the direction in which the covering fibers are fed into the triangular twisting space is an essential requirement for the making of uniform yarns of high strength, the quality of the yarn will also depend on a proper tying of the covering fibers into the fibrous structure formed from the drawn roving as it is twisted. The covering fibers can be more effectively tied into the fibrous structure when the covering fibers fly freely into the twisting space. Besides, the provision of a drawing frame for the roving to be covered and of an additional drawing frame for the covering fibers will involve a relatively high structural expenditure. Moreover, the roving from which the covering fibers are derived cannot readily be drawn to any high degree which may be desired so that yarns, particularly if they are thin, must be expected to contain a relatively high proportion of covering fibers.

SUMMARY OF THE INVENTION

It is an object of the invention so to improve an apparatus which is of the kind described first hereinbefore that the proportion of covering fibers in the yarn will be very low and the advantage afforded by a constraint of the covering fibers as are fed can be combined with the advantage afforded by a tying of freely flowing covering fibers into the fibrous structure being twisted.

This object is accomplished in accordance with the invention in that the fiber-feeding means comprise a feed roller, which precedes the twisting drums and is aligned with the triangular twisting space in its longitudinal direction and has an axis of rotation that extends transversely to the center plane between the two twisting drums, and the feed roller comprises a peripheral region to which a vacuum is applied and a blasting region, which is axially disposed beside said peripheral region and faces the triangular twisting space and in which a partial stream of fibers is formed.

Because a peripheral region to which a vacuum is applied and a blasting region are axially juxtaposed, the roving which is being fed to the twisting drums via the feed roller is divided in that those fibers of the roving which are being fed in the axial extent of the blasting region are blown off the feed roller as said fibers reach the blasting region. On the other hand, those fibers which are fed on that peripheral region to which a vacuum is applied will be moved under a constraint, which will be interrupted only by the short free path between the feed roller and the triangular twisting space. But the twisting of the fibers will be initiated on that free path so that an adequate coherence of the fibers will be ensured and the fibers which have thus been twisted will constitute the core of the yarn to be made whereas the fibers which have been blown off the feed roller will be wound about said core under conditions which can otherwise be obtained only with freely flowing fibers entering the triangular twisting space. The air blast which extends substantially in the center plane between the two twisting drums also spreads the stream of blown-off fibers over a larger axial length of the line of yarn formation because the fibers are blown over different distances. That spreading will not impede the feeding of the blown-off fibers into the triangular twisting space.

An adequate constraint of the fibers which have been blown off can be ensured by the provision of a suction region, which precedes the blasting region in the direction of rotation of the feed roller and which will maintain the orientation of the fibers on the feed roller until the fibers are blown off said roller. In that case the cooperation of the blasting region and the preceding suction region will ensure that the fibers which are being tied like freely flowing fibers into the fibrous structure as it is twisted will be aligned with the triangular twisting space even as the fibers are flying.

The partial stream of fibers which is fed over that peripheral region of the feed roller to which a vacuum is applied should be uniformly pulled from the feed roller. This can be accomplished in that a pressure-applying roller is provided, which is associated with the feed roller and disposed at the delivery end of the peripheral region to which a vacuum is applied. Said pressure-applying roller defines with the feed roller a nip, which constitutes a passage for the partial stream of fibers. As a result, the pressure-applying roller defines a point of withdrawal for that partial stream of fibers and the partial stream of fibers cannot wander in the region in which it is delivered. Such wandering would adversely affect the uniformity of the yarn.

In a particularly desirable design the feed roller is constituted by one of the delivery rollers of a drawing frame. In that case the constraint of the drawn fibers of the sliver which has been supplied to the drawing frame will not be adversely affected by the transfer of the fibers to a feed roller which succeeds the drawing frame.

In the entraining air stream for feeding the fibers detached from the feed roller into the triangular twisting space the turbulence should be minimized. This can be accomplished in that a fiber-guiding duct is provided for guiding the fibers which have been detached from the feed roller into the triangular twisting space. Said fiber-guiding duct will effect an additional guidance of the partial stream of fibers which have been blown off because the suction stream existing in the triangular twisting space will be effective also in the triangular twisting space so that the directional feeding of the fibers which have been transferred by the air blast from the feed roller in the blasting zone into the fiber-guiding duct will be assisted by the subatmospheric pressure that exists at the exit of the fiber-guiding duct adjacent to the triangular twisting space. The various controlling variables can properly be matched so that a substantially laminar stream in the fiber-guiding duct can be achieved. It is apparent that the fiber-guiding duct will ensure that the transfer of the detached fibers from the feed roller into the triangular twisting space will not be affected by external influences.

DETAILED DESCRIPTION OF THE PREFERRED EMBODIMENT

Figures 1, 2, 3:
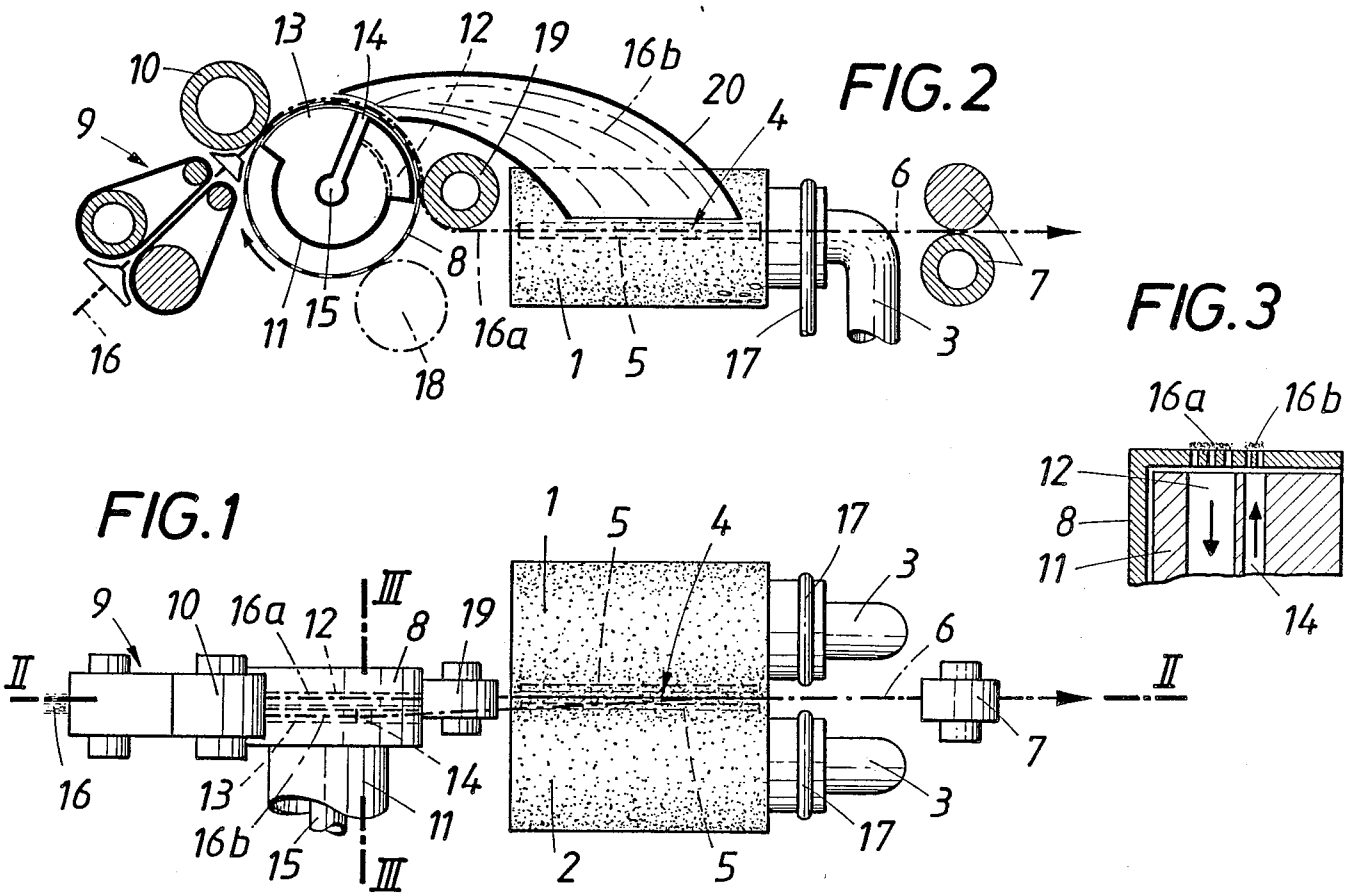
FIG. 1 is a diagrammatic top plan view showing apparatus in accordance with the invention for making a yarn.
FIG. 2 is a sectional view taken on line II—II in FIG. 1.
FIG. 3 is an enlarged sectional view taken on line III—III in FIG. 2.

An illustrative embodiment of the invention is shown on the drawing.

The embodiment shown by way of example comprises two air-permeable twisting drums 1 and 2, which are juxtaposed closely spaced apart and are provided with suction inserts 3. The suction inserts 3 constitute axially extending suction zones 5, which face the generally triangular twisting space 4 that is defined by the two twisting drums 1, 2. As a result, any fibers which may be introduced into the triangular twisting space 4 will be twisted together between the two twisting drums 1 and 2 to form a yarn 6, which can be withdrawn from the triangular twisting space 4 at its exit end by withdrawing means 7.

Fibers are introduced into the triangular twisting space 4 by a feed roller 8 which, in the embodiment shown by way of example, is constituted by a delivery roller of a drawing frame 9, which has a second delivery roller 10. The feed roller 8 has an axis of rotation that extends at right angles to the center plane between the two twisting drums 1 and 2. The feed roller precedes the two twisting drums at the entrance end of the triangular twisting space 4 and is aligned with the triangular twisting space 4 in its longitudinal direction. The feed roller 8 is provided with a suction insert 11, which causes the feed roller 8 to have a first peripheral region 12, to which a vacuum is applied, and to have a second peripheral suction region 13 adjacent a triangular delivering space between the delivery rollers 8 and 10 of the drawing frame 9. The suction region 13 is axially disposed beside the peripheral region 12 and, in the direction of rotation of the feed roller 8, is succeeded by a peripheral blasting region 14, which is supplied with an air blast from a compressed air pipe 15.

As that peripheral region 12 of the feed roller 8 to which a vacuum is applied is axially closely spaced from the suction region 13, the roving 16 which has been drawn in and emerges from the drawing frame 9 will be spread toward the peripheral regions 12 and 13 so that the roving 16 will be divided into two partial streams of fibers **16*a* and 16*b* in dependence on the position of the roving 16 relative to the two axially juxtaposed suction regions 12, 13. Because the roving has been drawn before it is divided into two partial streams of fibers, the partial stream of fibers 16*b* which has been derived from the drawn roving and serves to provide the covering fibers may constitute a relatively low proportion of the fibers of the roving 16**.

The partial stream of fibers **16*a* is moved under a constraint as it moves on the feed roller 8 over the length of that peripheral region 12 to which a vacuum is applied and until the partial stream of fibers 16*a* is detached from the feed roller 8 and pulled through the triangular twisting space 4. The partial stream of fibers 16*b* which has been diverted from the drawn roving is blown off the feed roller 8 at the end of the suction region 13 by the air blast in the blasting region 14 and by said air blast is introduced in the form of flying fibers into the triangular twisting space 4 so that the covering fibers are tied like freely flowing fibers into the fibrous structure as it is twisted. Owing to the alignment of the feed roller 8 with the triangular twisting space 4, the fibers which have been blown off will fly along simple trajectories and owing to the different flight distances the points of impact of the covering fibers on the roving being twisted will be distributed over a relatively large length portion of the triangular twisting space 4**.

It is desired to select the velocities at which the partial streams of fibers **16*a* and 16*b* are fed independently of the surface velocity of the twisting drums 1 and 2. For that purpose the feed roller 8 is driven by means which are separate from those for driving the twisting drums 1 and 2. The twisting drums 1 and 2 are driven by belt drives 17. The feed roller 8 is driven by means of a friction wheel 18, which is indicated by dash-dot lines in FIG. 2**.

The location at which the partial stream of fibers **16*a* is detached from the feed roller 8 at the end of the peripheral region 12 to which a vacuum is applied is defined by a pressure-applying roller 19, which defines a nip that is passed through by the partial stream of fibers 16*a* and which guides said stream 16*a* from the feed roller 8 toward the triangular twisting space 4. The fibers of the partial stream 16*b* which have been blown off enter a fiber-guiding duct 20, which is indicated in FIG. 2 and promotes the aligning of the fibers which have been blown off and ensures that said fibers will not be affected by external influences as the fibers are fed to the triangular twisting space 4**.

I claim:

1. In apparatus for making a yarn, comprising two closely juxtaposed twisting drums defining a generally triangular twisting space therebetween, the twisting space having a longitudinal center plane, an entrance end, and an exit end opposite to the entrance end, vacuum-applying means for applying a vacuum through said twisting drums to said twisting space, fiber-feeding means for feeding fibers to said twisting space at said entrance end, drum-driving means for rotating said twisting drums in the same sense so as to cause said fibers to be twisted together in said twisting space and to form a yarn, and yarn-withdrawing means for withdrawing said yarn from said twisting space at said exit end, the fiber-feeding means comprising a feed roller disposed adjacent said entrance end of said twisting space and aligned with the latter in its longitudinal direction, the feed roller having an axis of rotation that is transverse to said longitudinal center plane and first and second axially juxtaposed peripheral regions, said second region facing said twisting space, vacuum-applying means for applying a vacuum to said first region, fiber-delivering means for delivering fibers to said peripheral regions of said feed roller, feed roller-driving means for rotating said feed roller so as to move said fibers along said peripheral regions, and blasting means for directing an air blast against said second region so as to detach part of said fibers and to form a partial stream of detached fibers.

2. The apparatus set forth in claim 1, wherein said feed roller comprises a third peripheral region axially juxtaposed said second region on a side opposite to said first region and preceding the second region in the direction of rotation of the feed roller, and vacuum-applying means for applying a vacuum to said third region.

3. The apparatus set forth in claim 1, wherein said first region has a delivery end adjacent the twisting space, and comprising a pressure-applying roller for cooperating with said first region at said delivery end.

4. The apparatus set forth in claim 1, wherein said fiber-supplying means constitutes a drawing frame including two fiber delivery rollers, and said feed roller is one of said delivery rollers.

5. The apparatus set forth in claim 1, further comprising a fiber-guiding duct arranged to receive said partial stream of detached fibers adjacent to said feed roller and to deliver the same to said triangular twisting space.

* * * * *